United States Patent [19]

Green, Jr.

[11] 4,259,970

[45] Apr. 7, 1981

[54] SMOKE GENERATING AND DISPENSING APPARATUS AND METHOD

[76] Inventor: William D. Green, Jr., 8906 Camden St., Alexandria, Va. 22308

[21] Appl. No.: 104,701

[22] Filed: Dec. 17, 1979

[51] Int. Cl.[3] ..... A24F 1/10; A24F 47/00

[52] U.S. Cl. ..... 131/330 R; 131/185

[58] Field of Search ..... 131/172, 171, 171 A, 131/170, 170 A, 185

[56] References Cited

U.S. PATENT DOCUMENTS 3,889,690 6/1975 Guarnieri ..... 131/171 R

FOREIGN PATENT DOCUMENTS 1518079 2/1968 France ..... 131/171 R

*Primary Examiner*—Stephen C. Pellegrino

*Attorney, Agent, or Firm*—Jacob Shuster

[57] ABSTRACT

Comminuted material conveyed from a hopper by a blower induced airstream accumulates on a screen. When a measured amount of material accumulates on the upstream side of the screen, a burner is energized to effect combustion of the material, producing smoke and unclogging the screen. The smoke is displaced by the airstream through the screen and is discharged therewith from a smoke outlet.

17 Claims, 13 Drawing Figures

SMOKE GENERATING AND DISPENSING APPARATUS AND METHOD

BACKGROUND OF THE INVENTION

This invention relates to the generation and dispensing of smoke by combustion of various solid materials including, but not necessarily limited to, leafy materials such as tobacco as well as various medicinal materials.

Smoke generating apparatus wherein solid material such as tobacco is burned so as to produce smoke is well known. Burning of material supported on a screen that also serves as an electrical burner element, is disclosed, for example, in U.S. Pat. No. 3,889,690 to Guarnieri. According to the Guarineri patent, air under pressure passes through the screen to support combustion of the material on the downstream side of the screen to produce smoke that is displaced by the air stream to an outlet conduit. No facilities are disclosed in the Guarineri patent for preconditioning the material, measuring the quantity of material to be burned or for regulating and controlling the density of smoke or the smoke producing operation. As a result, smoking apparatus of the foregoing type becomes clogged rather rapidly and requires frequent maintenance and replacement of parts. Further, the smoke producing operation becomes inefficient with use and frequent cleaning and recharging of the smoking appliance is necessary.

It is therefore an important object of the present invention to provide a smoking appliance of the foregoing type having an adjustment capability for producing the desired smoke density in accordance with different user needs.

A further object in accordance with the foregoing object is to provide a smoke generating and dispensing device and method through which smoke is generated and dispensed in a more efficient manner by avoiding accumulation of combustion residue on a material supporting screen.

Still further objects of the present invention include the provision of smoking apparatus that require less maintenance and replacement of parts after prolonged use.

Yet another object is to provide a smoke generating apparatus in which the amount of material being burned is automatically determined for producing the desired quantity of smoke.

SUMMARY OF THE INVENTION

In accordance with the present invention, a smoke generating and dispensing apparatus is provided wherein a gas permeable screen is positioned within a circulating air flow passage through which a blower induced flow of air conveys particulate material from a hopper to the screen on which the material accumulates on the upstream side thereof. Accumulation of material on the screen restricts flow of air, producing a buildup of pressure on the upstream side in preparation for an efficient smoke producing phase of operation. When a predetermined air pressure buildup occurs as indicated by a pressure sensor, the smoke generating phase of operation is initiated by operation of a burner. during the smoke generating phase of operation, recirculation flow through the hopper may be interrupted by valve means and smoke is discharged on the downstream side of the screen. An inflow of air is induced by suction pressure to maintain combustion. Burning of the material during the smoke generating phase unclogs the screen while producing smoke so as to effect displacement of the smoke by the blower-induced flow of air through the screen.

Electrical control means are provided for energizing a blower motor to effect the aformentioned accumulation of material on the gas permeable screen under air pressure buildup so as to create optimum combustion conditions before energization of an electrical burner. A battery source of voltage or suitably converted commercially available AC voltage may be utilized for this purpose. Comminuting means may be provided for preconditioning the material by reduction to suitable particle size whenever operation of the blower is initiated. A precisely measured charge of such preconditioned material withdrawn from the hopper may be utilized for each operational cycle as determined by a pressure sensor detecting the aforesaid pressure buildup on the upstream side of the screen.

In accordance with certain embodiments of the invention, the material is comminuted by a cutter blade driven by the blower motor, the blade being located above an apertured plate through which cut material is drawn from the hopper into the blower chamber. A valve plate rotatable relative to the apertured plate may control flow of comminuted material into the blower chamber. The valve plate may be formed integral with an upper rotatable housing section enclosing the hopper in one embodiment of the invention. A position responsive switch then controls enerization of the blower motor and the burner.

DETAILED DESCRIPTION OF SPECIFIC EMBODIMENTS

Figure 1:
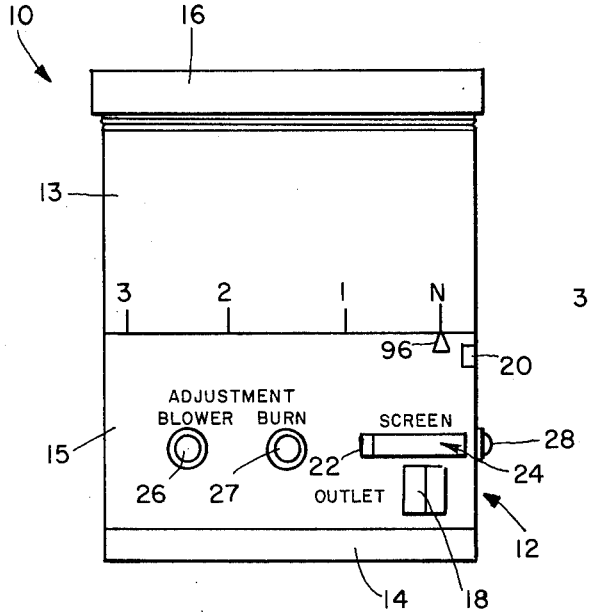
FIG. 1 is a front elevation view of a smoke generating and dispensing apparatus constructed in accordance with the present invention.
Figure 2:
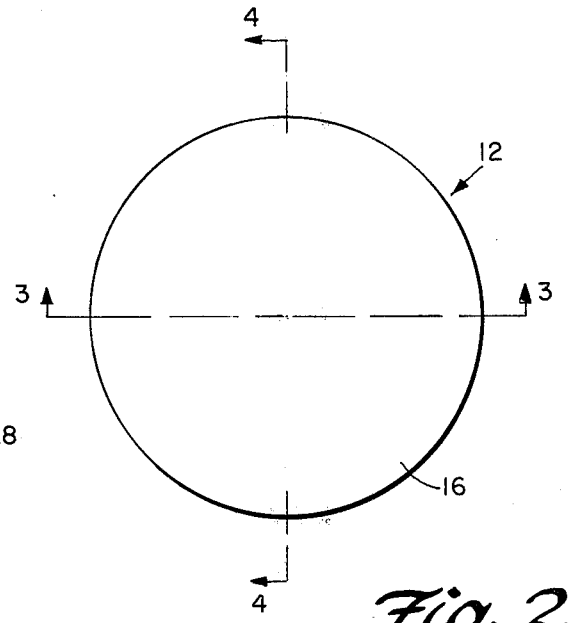
FIG. 2 is a top plan view of the apparatus shown in FIG. 1.

Referring now to the drawings in detail, FIGS. 1 and 2 illustrate a smoke generating and dispensing unit constructed in accordance withe the present invention and generally referred to by reference numeral 10. In the embodiment illustrated, the housing is generally cylindrical in shape having an outer housing 12 closed at one axial end by a circular base 14 and at the other axial end by a cover 16. The housing includes upper and lower section 13 and 15 that are relatively rotatable about the longitudinal axis of the housing. The outer surface of the lower housing section 15 as shown in FIG. 1 is provided with a smoke outlet orifice 18 from which the smoke generated internally of the unit 10 is dispensed and an air inlet orifice 20. The outlet 18 and inlet 20 may be made adjustable in size. A recess 22 is formed in housing section 15 through which a removable gas permeable screen assembly 24 is inserted into or withdrawn from the apparatus as will be explained in detail hereinafter. In order to regulate operation of the apparatus in the illustrated embodiment, rheostat controls 26 and 27 are mounted on the housing section 15 for adjustment of blower speed and burn intensity. The raw material from which the smoke is produced is loaded into the apparatus by removal of a cover 16 at its upper end. An indicator 28 is also provided on the housing section 15 adapted to be illuminated when the apparatus is ready for a smoke generating phase of operation.

Referring now to FIGS. 3 through 6 in particular, the cylindrical housing is preferably made of electrically non-conductive material. A pair of fastener bolts 30 interconnect the housing section 15 and the base 14. The cover 16 is removably secured to the upper section 13 by a threaded connection at 32. The lower housing section is internally formed with a cylindrical chamber 34 at its lower end within which an electrical blower motor 36 is housed. A power shaft 38 extends upwardly from the motor for rotation about a rotational axis which is offset from the longitudinal axis of the cylindrical housing 12. The motor chamber 34 is separated by a partition wall 39 from a blower chamber 40 coaxial with the motor shaft 38. A centrifugal blower fan blade assembly 42 of a conventional type is secured to the motor shaft within chamber 40.

Figure 6:
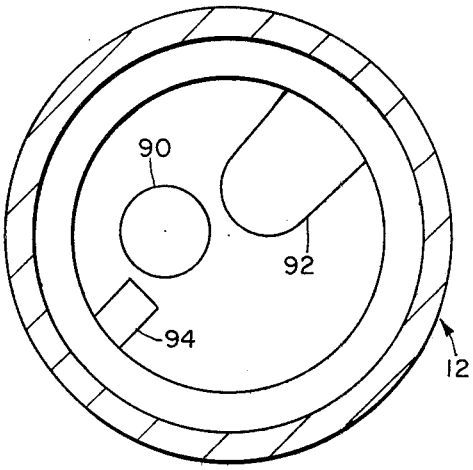
FIG. 6 is a transverse section view taken substantially through a plane indicated by section line 6—6 in FIG. 3.
Figure 7:
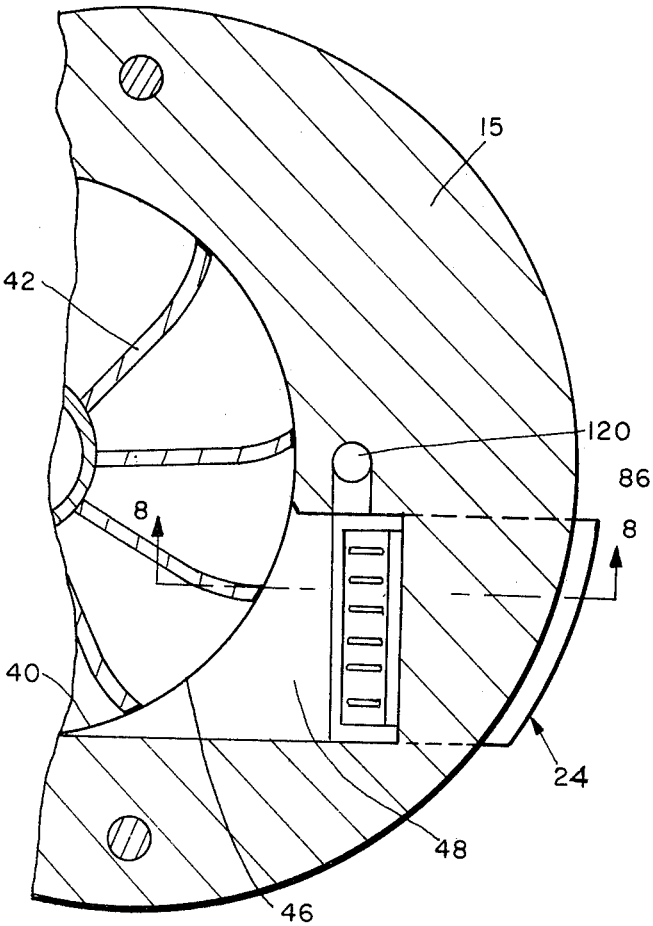
FIG. 7 is an enlarged partial section view taken substantially through a plane indicated by section line 7—7 in FIG. 3.

The blower chamber 40 is provided with an axial inlet opening 44 in an upper wall 45 and a lateral outlet opening 46 as shown in FIG. 7 from which air is discharged into a pressure chamber 48 formed in the cylindrical housing between walls 39 and 45. The pressure chamber 48 forms a part of a flow passage establishing fluid communication between the outlet opening 46 of the blower chamber 40 and a hopper formed by a chamber 52 above the blower chamber. The hopper chamber is in communication with a return passage 50 in housing section 15 through a bottom wall 54 of the hopper as more clearly seen in FIGS. 5, 6 and 10.

Figure 3:
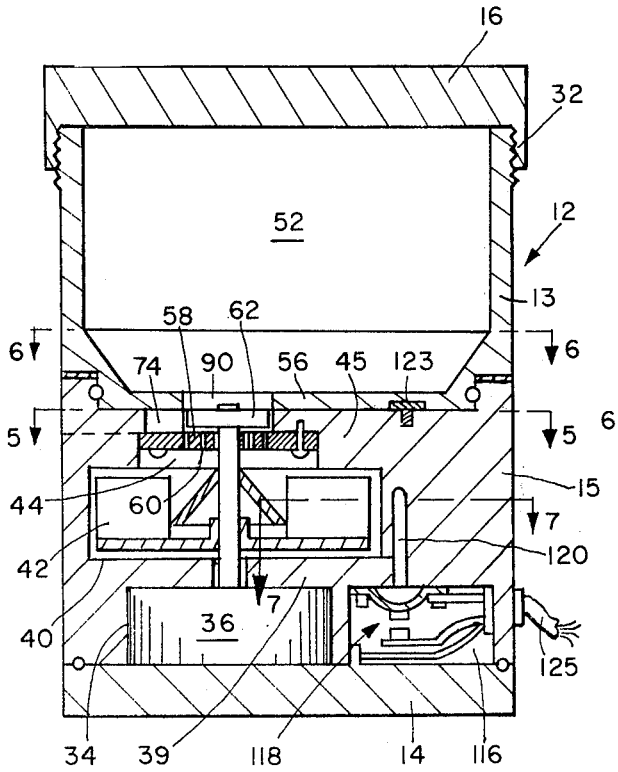
FIG. 3 is a longitudinal side section view taken substantially through a plane indicated by section line 3—3 in FIG. 2.
Figure 4:
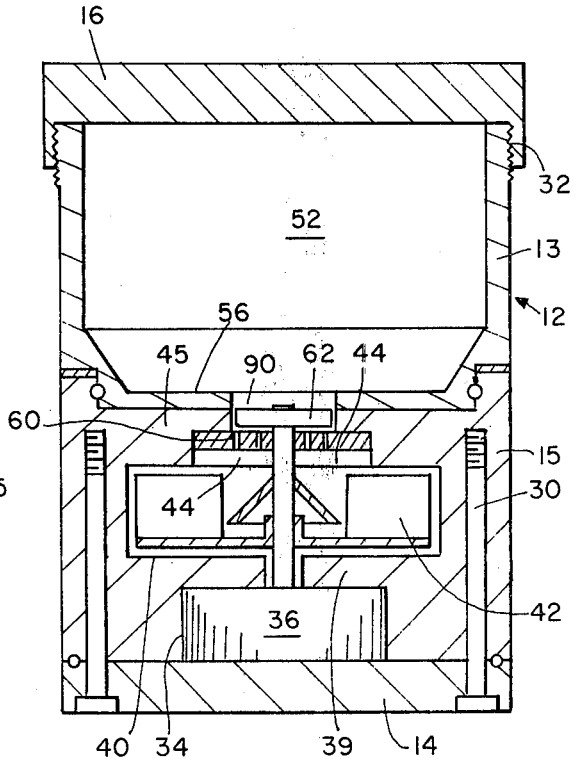
FIG. 4 is a longitudinal section view taken substantially through a plane indicated by section line 4—4 in FIG. 2.
Figure 5:
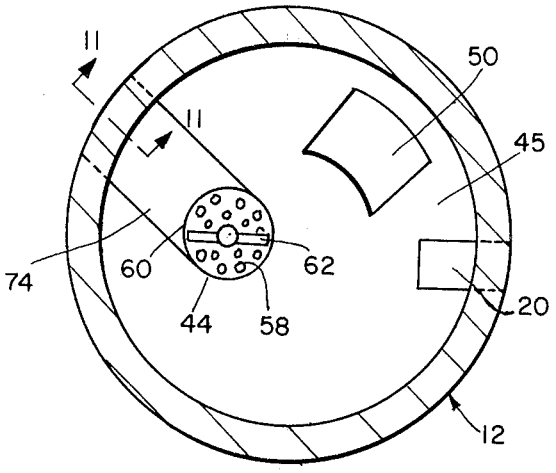
FIG. 5 is a transverse section view taken substantially through a plane indicated by section line 5—5 in FIG. 3.

As more clearly seen in FIGS. 3, 4 and 5, a comminuting assembly 56 includes an apertured plate 58 secured to the wall 45 within inlet opening 44 of the blower chamber. Comminuting blades 62 are secured to the motor shaft 38. Thus, simultaneously with operation of the blower, the blades 62 will be effective to comminute the leafy material stored in chamber 52 suitable for being fluidized and conveyed by the outflow stream of air from the blower. Accordingly, upon rotation of the blower fan blade assembly 42, the comminuted material or particles from the hopper chamber 52 are drawn under suction pressure through the apertures 60 in plate 58 for discharge into pressure chamber 48 from blower outlet 46.

Figure 8:
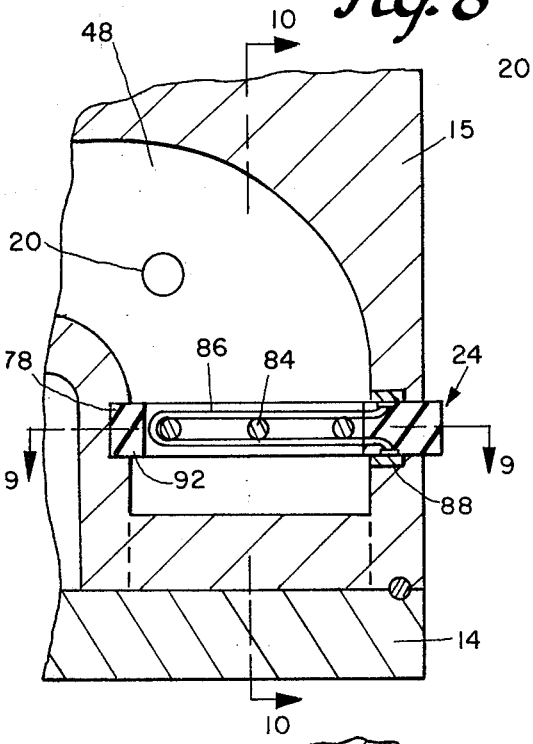
FIG. 8 is a partial section view taken substantially through a plane indicated by section line 8—8 in FIG. 7.
Figure 10:
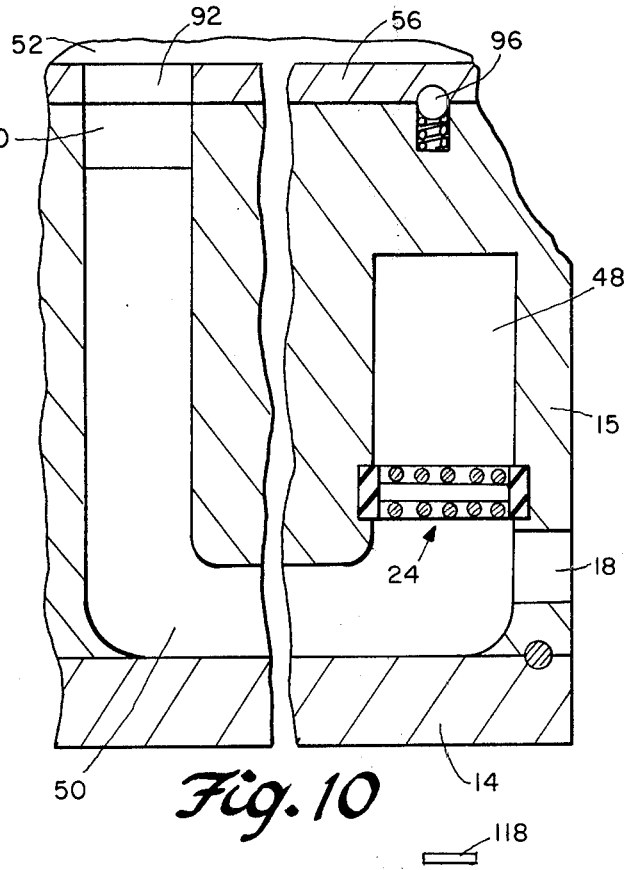
FIG. 10 is a partial section view taken substantially through a plane indicated by section line 10—10 in FIG. 8.

As more clearly seen in FIG. 7, 8 and 10, the pressure chamber 48 is separated by the screen assembly 24 from the return passage 50. While the flow of air induced by the blower may readily pass through the screen 24 to produce a circulating stream of air, the screen assembly is dimensioned to block entry of the particulate material into the return passage 50.

Figure 11:
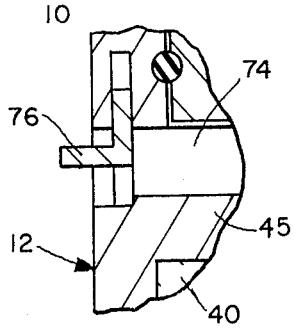
FIG. 11 is an enlarged partial section view taken substantially through a plane indicated by section line 11—11 in FIG. 5.

A certain amount of fresh air enters the apparatus through an air inlet passage 74 extending into inlet 44 as more clearly seen in FIG. 5 to support combustion. The air inlet opening 74 may be closed to an adjusted extent by means of a slidably mounted orifice adjustment valve 76 as more clearly seen in FIG. 11. Air inlet 20 aforementioned admits air into the return passage 50 during continuous smoke generating operation.

Figure 9:
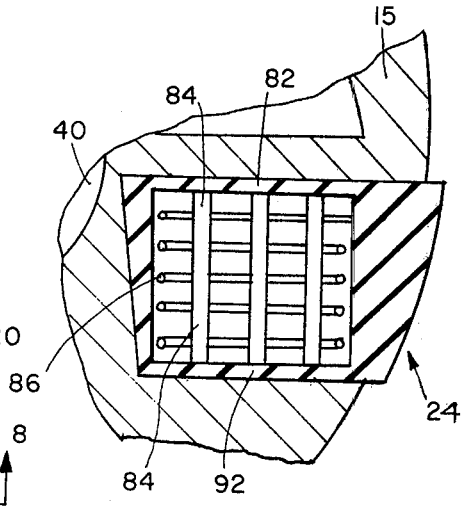
FIG. 9 is a partial section view taken substantially through a plane indicated by section line 9—9 in FIG. 8.

The screen assembly 24 when inserted into the housing at recess 22, abuts a recess 78 formed in the housing section 15 as more clearly seen in FIGS. 7, 8 and 9. The screen assembly 24 may be formed from a frame 82 made of a non-conductive material having parallel spaced support rods 84 on which an electrical heating coil element 86 is mounted. The electrical heating coil element constitutes a burner by means of which material accumulated on the screen assembly is ignited for combustion in order to produce smoke. The coil spacing of the heating element 86 and the spacing between the support rods 84 is such as to establish the desired screen openings which will block passage of the material particles without substantially impeding the flow of air except when the screen assembly becomes clogged by an accumulation of particles on its upstream side. If desired, the entire screen could be formed by the heating element without any non-heating support rods 84. The screen assembly is inserted through an opening formed in the recess 22 provided with contacts 88 as shown in FIG. 8 in order to establish an electrical connection between the heating element 86 and a source of electrical voltage.

As shown in FIGS. 3, 5 and 6, the bottom wall 56 of the hopper forms a gate valve plate provided with valve openings 90, 92 and plate 94. The valve plate 56 is angularly displaceable from a neutral position to three operative positions in which it is yieldably held by a detent 96 as shown in FIG. 10. In a first operative position shown in FIGS. 3 and 6, the valve plate opening 92 is aligned with return passage 50 while opening 90 is aligned with blower inlet 44 to support recirculating flow. This operative position corresponds to the No. 1 position as denoted by index 96 shown in FIG. 1. The valve plate 56 is angularly displaced to a flow blocking position by rotation of the upper housing section 13 to position No. 2 in which both return passage 50 and inlet 44 are blocked to accommodate a burn operation of limited duration. As previously indicated, air for combustion purposes during this phase of operation is drawn in through air inlet 74. In position No. 3, opening 92 is aligned with blower inlet 44 while opening 94 is aligned with the air inlet 20 to accommodate a continuous burn operation of indefinite duration.

As shown in FIG. 3, the housing section 15 is provided with a control chamber 116 within which wiring from the contacts 88 are received and a pressure sensor switch assembly 118 is mounted. The sensor switch assembly is in communication with the pressure chamber 48 through a sensing passage 120. Accordingly, whenever the pressure builds up in chamber 48 reflecting a predetermined accumulation of comminuted particles on the upstream side of the screen assembly 24, the pressure switch closes in order to effect illumination of the indicator 28. Although a visual type of indicator 28 is shown, it should be appreciated that other types of indicators may be utilized including audible indicators.

Figure 12:
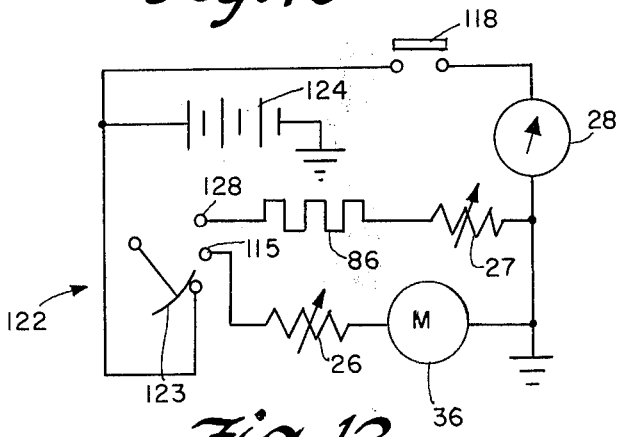
FIG. 12 is an electrical circuit diagram depicting a control assembly for the apparatus illustrated in FIGS. 1-11.

Referring now to FIG. 12, a control circuit 122 is shown, by way of example, for controlling operation of the apparatus. The control circuit is connected to a suitable source of electrical energy 124 to which a position responsive switch 123 and the pressure sensor switch 118 are connected in parallel. The power source may be a battery or an AC source connected to the apparatus by a power cable 125 shown in FIG. 3. The position responsive switch 123 may be mounted on the bottom of the rotatable hopper 56 for example as shown in FIG. 3. In the positions of the switches as shown, the control circuit is open. When switch 123 engages contact 115 in the No. 1 position, energizing current to the blower motor 36 is supplied to operate the blower motor 36. When switch 123 engages contact 128 in the No. 2 position and in the No. 3 position, both motor 36 and burner 86 are energized. The electrical burner element 86 is connected in series with adjustable control 27 through which combustion may be adjusted. The adjustable control 26 is used to regulate the speed of the blower motor as aforementioned.

Switch 123 is open as shown in FIG. 12, when the section 13 is in its neutral position and the apparatus 10 is in a quiescent condition. To initiate operation, the section 13 is rotated to its No. 1 position so that switch 123 engages contact 115 to energize the blower motor. As long as the section 13 is held in the No. 1 position, the blower motor remains energized to rotate the blower fan blade 42 and the material comminuting blade 62 at an adjusted speed. During this phase of operation, comminuted material is carried into the pressure chamber 48 by the blower airstream, the air being recirculated back to the hopper chamber through the unblocked return passage 50 after passing through the screen assembly 24. Comminuted material will collect on the upstream side of the screen assembly so that the pressure in the pressure chamber 48 rises as the screen assembly becomes progressively clogged to restrict continued air flow therethrough. When the pressure buildup in chamber 48 reaches a predetermined value, pressure sensor switch 118 closes to energize indicator 28. Illumination of the indicator will signify to the user that the apparatus is ready to generate smoke.

When the indicator is illuminated, the user rotates housing section 13 to the No. 2 position thereby blocking the return passage and inlet 44 to the blower chamber. The switch 123 then engages the contact 128 to initiate a burn operation by energizing heating element 86. When the housing section 13 is rotated to the No. 3 position, the burner and blower motor remain energized and fluid communication between the hopper and the blower inlet 44 is established through opening 92 and between the hopper and air inlet 20 through opening 94. In both the No. 2 and No. 3 positions, smoke is generated by burner 86 and is discharged from outlet 18. In the No. 2 position, however, the smoke will decrease as the charge of material trapped in chamber 48 is consumed by combustion. In the No. 3 position, new material may continue to flow from hopper 52 into chamber 28 in order to effect a continuous burn operation. Thus, the user may govern smoke density and smoke duration by rotating housing section 13 between the three operating positions.

In the foregoing described embodiment of the invention, the smoke generating and dispensing phase of operation is manually initiated after observing illumination of the indicator 28 and is manually controlled to obtain the desired smoke density by either intermittent operation of burner 86 or by continuous operation thereof. By adjusting the orifice opening 74 in the housing through orifice size adjuster 76, air available for combustion may be regulated to control smoke density. The effective duration of each smoke generating phase of a cycle depends on the air inflow, the heating temperature, and the blower motor speed. The heat and blower motor speed may be adjusted through the adjustable controls 26 and 27 as shown in FIG. 12.

Figure 13:
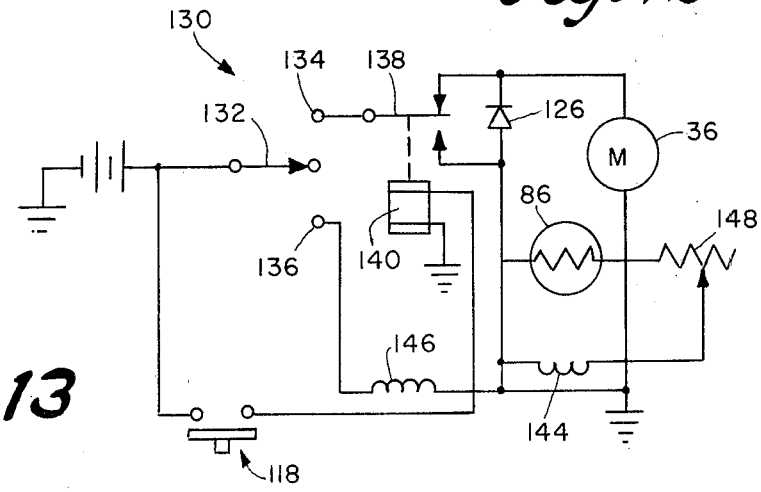
FIG. 13 is an electrical circuit diagram illustrating a modified form of control assembly for the apparatus.

The pressure sensing switch 118 may be used to automatically initiate a smoke generating phase of operation by means of a modified form of control circuit 130 as shown in FIG. 13. According to this embodiment of the invention, a three-position control switch 132 is displaced from an off-position against a spring bias to either an automatic position engaging contact 134 or a continuous load and burn position engaging contact 136. A hopper valve mechanism is automatically displaced between its three operative positions by an electric valve operator. In the automatic position of switch 132, the blower motor 36 is energized through a relay switch 138 in its normal position. When sufficient pressure buildup in the pressure chamber occurs, pressure switch 118 closes to energize relay coil 140. Relay switch 138 is thereby actuated to complete parallel circuits through the blower motor 36, the electrical heating element 86 and a solenoid valve actuator 144 which displaces the hopper valve from its No. 1 position to the No. 2 return passage blocking position against a return spring bias. As soon as the pressure in pressure chamber 48 decreases sufficiently, reflecting unclogging of the screen assembly 24, the pressure switch 118 opens to de-energize relay coil 140 and thereby restore the apparatus to its initial condition. The foregoing cycle is repeated for intermittent dispensing of smoke. The frequency and duration of the smoke generating phase of each cycle may be regulated by adjustment of the orifice opening 74 and the resistor 148 so that the screen assembly is unclogged by combustion. In the continuous burn position of switch 132, parallel energizing circuits are completed through the motor, heating element and valve actuating solenoids 142 and 146, bypassing the sensor switch 118, relay coil 140 and relay switch 138. The valve mechanism is displaced thereby to the No. 3 position. The rate of material accumulation in this mode of operation must be matched to the rate of combustion unclogging the screen assembly.

Having thus described certain embodiments of the invention in detail, it will be understood that various changes and modifications may suggest themselves to persons skilled in the art, all falling within the scope of the invention as defined by the appended claims.

What is claimed is:

1. In an apparatus for generating and dispensing smoke produced by combustion of solid material, a housing having a smoke outlet, a hopper within which said material is a stored, gas flow means for conveying said material from the hopper to the outlet, gas permeable means for blocking flow of the material to the outlet, and burner means mounted in operative relation to the gas permeable means for combustion of the material accumulated upstream on the gas permeable means producing smoke displaced through the gas permeable means.

2. The apparatus as defined in claim 1 including sensor means for detecting buildup of pressure upstream of the gas permeable means reflecting a predetermined accumulation of the material on the gas permeable means.

3. The apparatus as defined in claim 2 including selectively operable valve means for blocking outflow of the material from the hopper.

4. The apparatus as defined in claim 3 including return passage means for recirculating through the hopper, said valve means being operative to close the return passage means.

5. The apparatus as defined in claim 1 wherein said gas flow means includes an air blower mounted downstream of the hopper.

6. The combination of claim 1 including comminuting means operated simultaneously with the gas flow means for preconditioning said material within the hopper.

7. The combination of claim 1 including return passage means for recirculating flow through the hopper, and selectively operable valve means for closing the return passage means.

8. A method of producing and dispensing smoke by combustion of a solid material including the steps of: storing said material in a storage zone; circulating a forced flow of air through said storage zone to fluidize and convey said material; accumulating material conveyed from the storage zone at a location downstream thereof; burning the material accumulated at said location to produce smoke; and discharging said smoke downstream of said location.

9. The method of claim 8 wherein said flow of air is restricted by the accumulation of material at said location, the restriction being reduced by the burning of the material.

10. The method of claim 9 wherein said circulation of the air through the storage zone is blocked during the discharge of the smoke therefrom.

11. The method of claim 10 wherein the material is comminuted within the storage zone for reduction to particle size suitable for fluidization and conveyance by said flow of air.

12. The method of claim 11 wherein the material at said location is burned at a rate exceeding the rate of accumulation.

13. The method of claim 8 wherein the material is comminuted within the storage zone for reduction to particle size suitable for fluidization and conveyance by said flow of air.

14. The method of claim 8 wherein the material at said location is burned at a rate exceeding the rate of accumulation.

15. In an apparatus for generating and dispensing smoke produced by combustion of solid material, a housing having a smoke outlet, a hopper within which said material is stored, passage means extending through the housing for establishing fluid communication between the hopper and the smoke outlet, flow inducing means for conveying the material into the passage means, screening means mounted in the passage means for restricting flow therethrough, and burner means for effecting combustion of the material accumulated in the passage means at the screening means upstream relative to the smoke outlet, whereby the smoke produced by said combustion passes through the screening means for discharge downstream thereof from the outlet.

16. In the apparatus as defined in claim 15, means for detecting accumulation of a predetermined quantity of said material at the screening means.

17. In the apparatus as defined in claim 16, including means for initiating operation of the burner means in response to said detection of the predetermined accumulation of material at the screening means.

* * * * *